US011282447B2

(12) United States Patent
Kim et al.

(10) Patent No.: US 11,282,447 B2
(45) Date of Patent: Mar. 22, 2022

(54) GRADUAL RESOLUTION PANEL DRIVING FOR MULTI-PIXEL DENSITY OLED DISPLAY PANEL

(71) Applicant: Google LLC, Mountain View, CA (US)

(72) Inventors: Hyunchul Kim, San Jose, CA (US); Sun-Il Chang, San Jose, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 17/150,518

(22) Filed: Jan. 15, 2021

(65) Prior Publication Data

US 2021/0142721 A1 May 13, 2021

Related U.S. Application Data

(63) Continuation of application No. PCT/US2020/043842, filed on Jul. 28, 2020.

(60) Provisional application No. 62/881,608, filed on Aug. 1, 2019.

(51) Int. Cl.
*G09G 3/30* (2006.01)
*G09G 3/3208* (2016.01)

(52) U.S. Cl.
CPC ... *G09G 3/3208* (2013.01); *G09G 2340/0428* (2013.01)

(58) Field of Classification Search
CPC ..... G09G 3/30–3291; G09G 5/227; G09G 5/391; G09G 2340/04–0457; G09G 3/2044–2055; G09G 3/293–2935; G06F 3/14; G06F 3/12; G06F 3/041661
See application file for complete search history.

(56) References Cited

U.S. PATENT DOCUMENTS

2016/0042676 A1* 2/2016 Berkeley ..... G09G 3/006 345/589
2017/0076654 A1 3/2017 Wang
2017/0337904 A1* 11/2017 Du ..... G09G 3/3225
2018/0286306 A1* 10/2018 Chauhan ..... G09G 3/3406
2020/0234634 A1* 7/2020 Li ..... G09G 3/3233
2021/0151517 A1* 5/2021 Zhu ..... H01L 51/5265

FOREIGN PATENT DOCUMENTS

CN 207947007 10/2018
CN 209056269 7/2019

OTHER PUBLICATIONS

PCT International Search Report and Written Opinion in International Application No. PCT/US2020/043842, dated Oct. 1, 2020, 12 pages.

* cited by examiner

*Primary Examiner* — Sanghyuk Park
(74) *Attorney, Agent, or Firm* — Fish & Richardson P.C.

(57) ABSTRACT

A method includes displaying an image on an organic light-emitting (OLED) display panel that includes a first display area having a first pixel density and a second display area having a second pixel density lower than the first pixel density, and while displaying the image, deactivating individual pixels in the first display area corresponding to a proximity of the individual pixels to the second display area such that a region of the first display area adjacent the second display area has a virtual pixel density between the first pixel density and the second pixel density.

18 Claims, 4 Drawing Sheets

GRADUAL RESOLUTION PANEL DRIVING FOR MULTI-PIXEL DENSITY OLED DISPLAY PANEL

CROSS-REFERENCE TO RELATED APPLICATIONS

This application is a continuation of International Application No. PCT/US2020/043842, filed Jul. 28, 2020, which claims the benefit of U.S. Provisional Application No. 62/881,608, filed Aug. 1, 2019, the contents of each are incorporated by reference herein.

BACKGROUND

Electronic devices can include display panels.

SUMMARY

This specification describes techniques, methods, systems, and other mechanisms for gradual resolution panel driving. An organic light emitting diode (OLED) display panel may include areas with different pixel densities. The areas with different pixel densities may correspond to different resolutions. For example, a display panel may include a first area with four hundred pixels per inch (PPI) that surrounds a second area with one hundred fifty PPI.

The difference in pixel density between areas may be especially apparent to viewers where the areas border each other. For example, the drop in PPI from four hundred PPI to one hundred fifty PPI at a border between the first area and the second area may be very noticeable to a person viewing the display panel. The difference may be visibly jarring to a user and may distract a user.

Gradual resolution panel driving may compensate for the difference between pixel densities in areas of the display panel. For example, gradual resolution panel driving may make it less noticeable that a display panel includes a first area with four hundred PPI next to a second area with one hundred fifty PPI. Gradual resolution panel driving may hide the difference in the areas of the display panel from viewers and users may not even realize the display panel has areas with different pixel densities.

Generally, gradual resolution panel driving may be performed by deactivating some individual pixels in a first area of a display panel that has a higher pixel density than a second area of the display panel. For example, a row of pixels of a first area with four hundred PPI directly adjacent and above a row of pixels in a second area with one hundred fifty PPI may have a number of pixels deactivated so that the number of pixels that are emitting light in the row in the first area is the same as the number of pixels that are emitting light in the row of the second area. In the example, another row of pixels adjacent and above the row in the first area may have one more pixel activated than the row, and yet another row of pixels adjacent and above the other row may have three more pixels activated than the row adjacent to the second area.

In general, one innovative aspect of the subject matter described in this specification can be embodied in a method that includes displaying an image on an organic light-emitting (OLED) display panel that includes a first display area having a first pixel density and a second display area having a second pixel density lower than the first pixel density, and while displaying the image, deactivating individual pixels in the first display area corresponding to a proximity of the individual pixels to the second display area such that a region of the first display area adjacent the second display area has a virtual pixel density between the first pixel density and the second pixel density.

Other embodiments of this aspect include corresponding computer systems, apparatus, and computer programs recorded on one or more computer storage devices, each configured to perform the actions of the methods. A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

These and other embodiments can each optionally include one or more of the following features. In some aspects, while displaying the image, regions of the first display area that are more proximate to the second display area have virtual pixel densities that are more similar to the second pixel density. In certain aspects, the first display area includes pixels that are less spaced apart than pixels in the second display area. In some implementations, the virtual pixel density includes a density of pixels that emit light when the image is shown.

In some aspects, deactivating individual pixels in the first display area corresponding to a proximity of the individual pixels to the second display area such that a region of the first display area adjacent the second display area has a virtual pixel density between the first pixel density and the second pixel density includes receiving a deactivation pattern that indicates the individual pixels in the first display area to be deactivated while the image is displayed and deactivating the individual pixels in the first display area in accordance with the deactivation pattern. In certain aspects, the deactivation pattern includes a map of all the pixels in the display panel where the map indicates whether each of the pixels in the display panel should be kept off when images are displayed on the display panel. In some implementations, the deactivation pattern is determined based on images of the display panel driven with various configurations of the pixels turned off.

In some aspects, deactivating individual pixels in the first display area includes for each of the individual pixels that are to be deactivated, providing red, green, and blue values of zero, zero, zero for the pixel to a driver circuit for the display. In certain aspects, the second display area is surrounded by the first display area.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
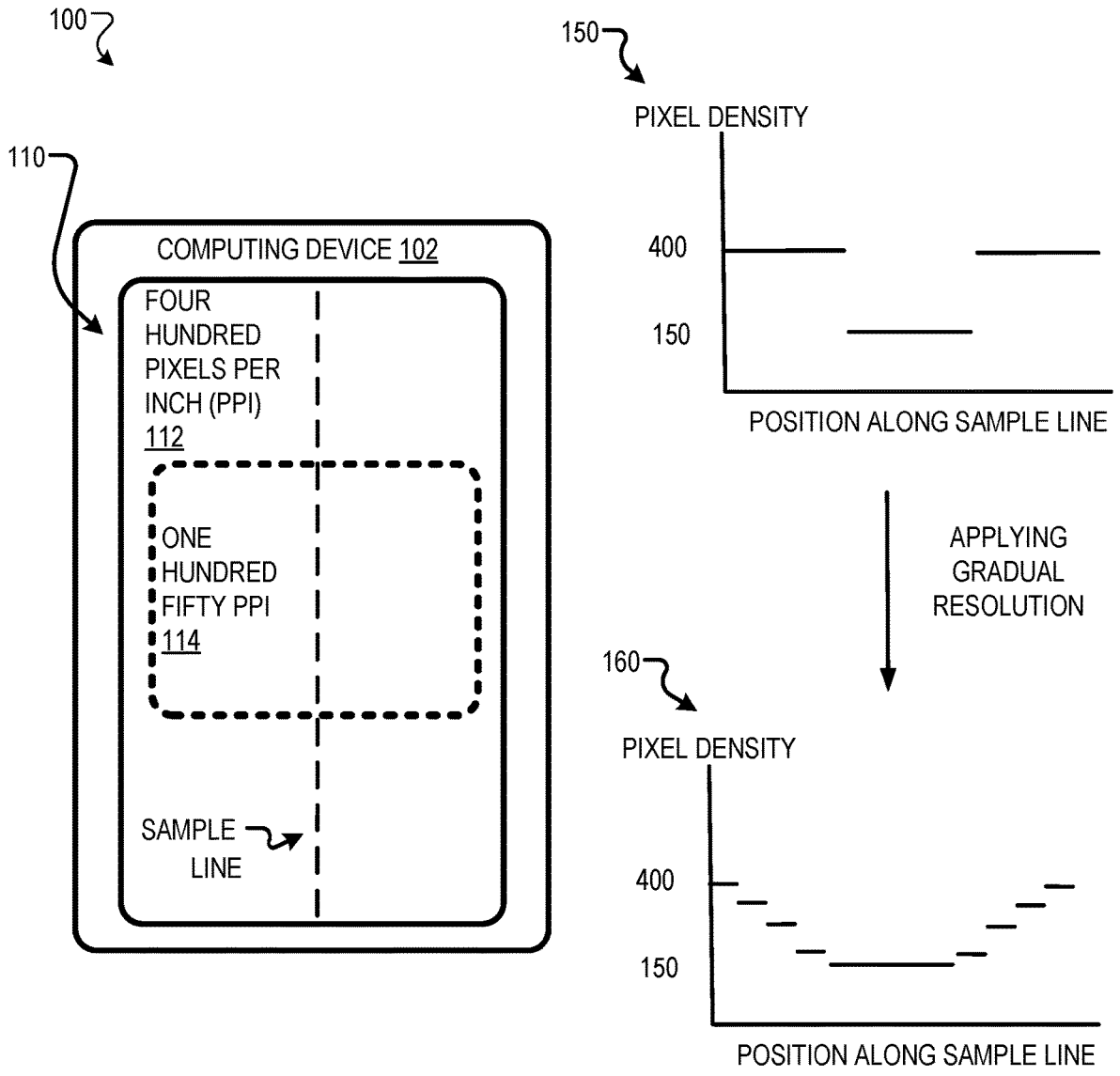
FIG. 1 is a block diagram of an example system before and after gradual resolution panel driving.

FIG. 1 is a block diagram of an example system 100 before and after gradual resolution panel driving. The system 100 includes a computing device 102 that includes the display panel 110. For example, the computing device 102 may be a smartphone, a tablet, or some other device.

The display panel 110 includes a first area 112 at a first pixel density and a second area 114 at a second pixel density. For example, the first area 112 may have four hundred pixels per inch (PPI) and the second area 114 may have one hundred fifty PPI. The first area 112 and the second area 114 may be positioned on the display panel 110 so that the areas share a boundary. For example, the second area 114 may be surrounded by the first area 112.

As shown on the left side of FIG. 1, when the display panel 110 displays image content, a border between the first area 112 and the second area 114 may be apparent. As shown in the graph at the top right of FIG. 1, pixel density along the sample line may change at the boundaries of the first area 112 and the second area 114. Accordingly, it may be readily apparent that the display 110 includes two different areas with different pixel densities.

The system 100 may use gradual resolution panel driving to reduce apparent differences between the first area 112 and the second area 114. As shown on the graph at the bottom right side of FIG. 1, when the display panel 110 displays image content using gradual resolution panel driving, the difference in pixel density between the first area 112 and the second area 114 may be made more gradual.

This may be done by including regions in the first area 112 that have virtual pixel densities between the pixel density of the first area 112 and the pixel density of the second area 114. A virtual pixel density may be an apparent pixel density that reflects a number of pixels that are deactivated. For example, a region that has only half of the pixels activated, meaning half of the pixels are deactivated, may have only half of the pixels emit light and the region may have a virtual pixel density that is half of the actual pixel density of the region.

A gradual change in pixel density in the first area 112 may be less noticeable to viewers. For example, gradually changing across ten rows from a row of pixels that correspond to four hundred PPI to a row of pixels that correspond to one hundred fifty PPI may be less noticeable than immediately changing from a row of pixels that corresponds to four hundred PPI to a row of pixels that corresponds to one hundred fifty PPI. Accordingly, it may be less apparent that the display 110 includes two different areas.

While FIG. 1 is shown with two nested areas, gradual resolution panel driving may similarly be applied to display panels with other number and arrangement of areas. For example, gradual resolution panel driving may be used to reduce differences between a display panel with four portions that all have different PPI and are arranged in a grid.

Figure 2B:
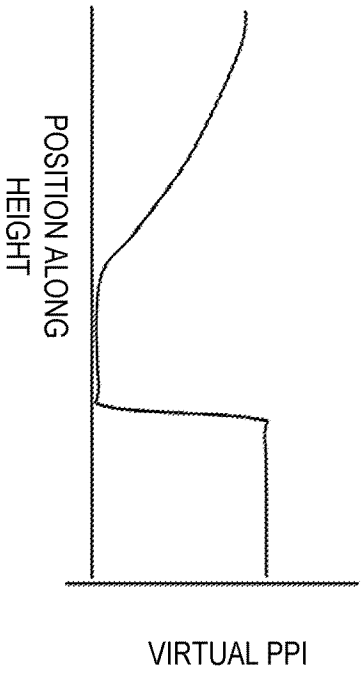
FIG. 2B is a graph of pixel density corresponding to the deactivation of pixels shown in FIG. 2A.
Figure 2A:
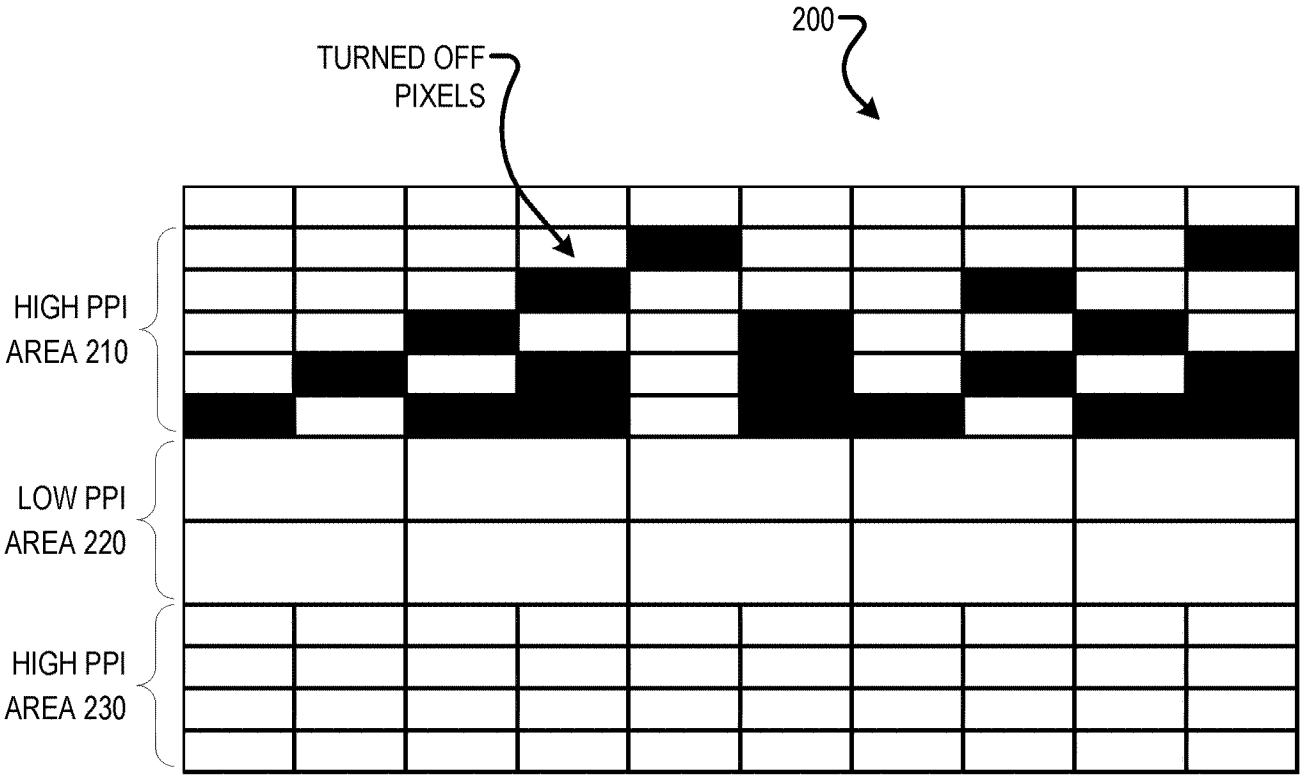
FIG. 2A is diagram of an example display panel with some pixels deactivated based on gradual resolution panel driving.

FIG. 2A is diagram of an example display panel 200 with some pixels deactivated based on gradual resolution panel driving. As shown in FIG. 2A, the display panel 200 includes a first area with a high pixel density 210, a second area with a low pixel density 220, and a third area with a high pixel density 230. For example, the first area 210 may have a pixel density of four hundred, the second area 220 may have a pixel density of one hundred fifty, and the third area 230 may have a pixel density of four hundred.

The first area 210 has some pixels deactivated based on gradual resolution panel driving, the second area 220 does not have any pixels deactivated, and the third area 230 does not have any pixels deactivated. As shown in FIG. 2A, the first row of pixels in the first area 210 may have no pixels deactivated, the second row of pixels may have a repeating pattern of three pixels activated and then one pixel deactivated, the third row of pixels may have a repeating pattern of two pixels activated and then two pixels deactivated, a fourth row may have a pattern of one pixel activated and then one pixel deactivated, and a fifth row may have a repeating pattern of deactivated, activated, deactivated, deactivated, activated, deactivated, deactivated, activated, deactivated, and deactivated.

FIG. 2B is a graph 250 of pixel density corresponding to the deactivation of pixels shown in FIG. 2A. The graph 250 shows how for the first area 210, the virtual pixel density gradually decreases, for the second area 220 the virtual pixel density is constant, for the third area 230 the virtual pixel density is constant, and there is a much larger drop in virtual pixel density where the third area 230 and the second area 220 border compared to where the first area 210 and the second area 220 border.

Figure 3:
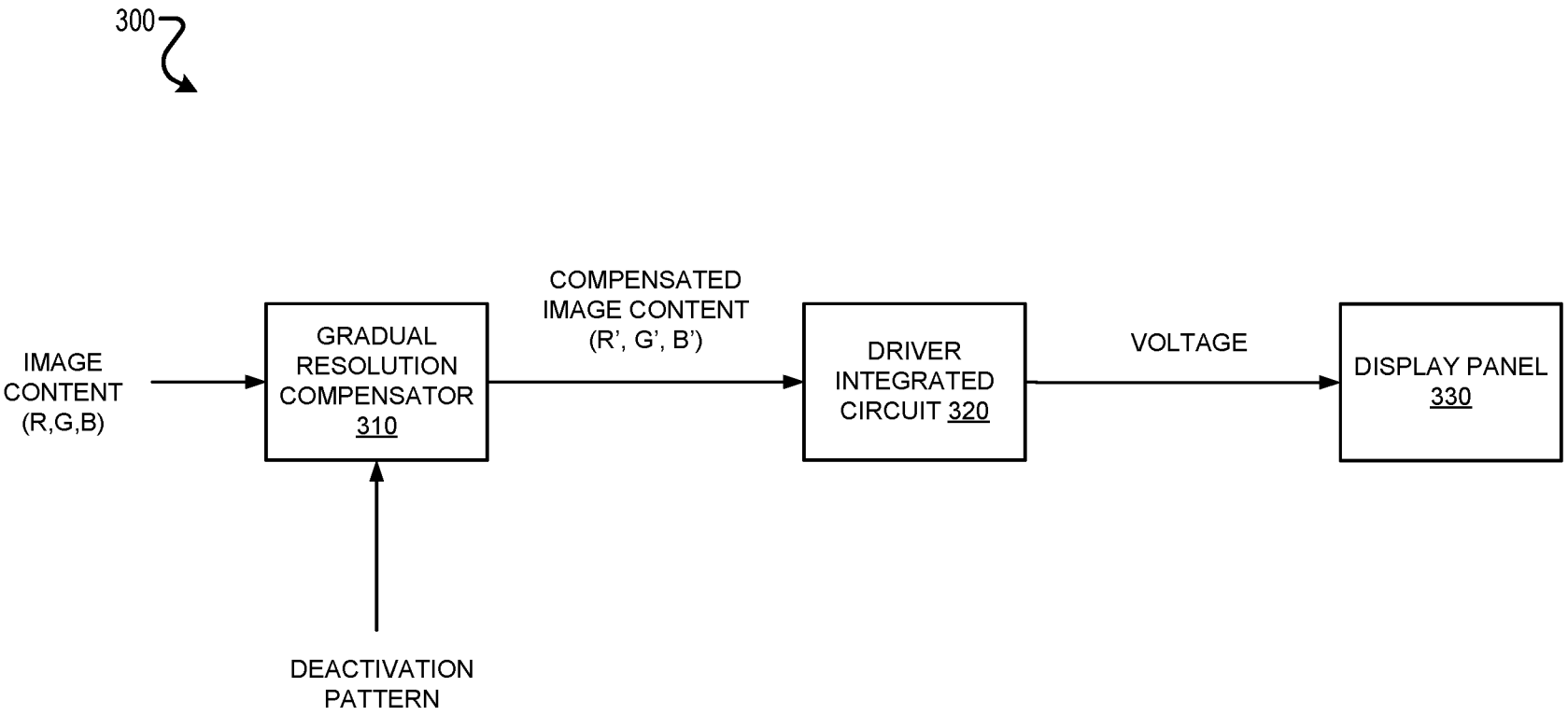
FIG. 3 is block diagram of an example system that performs gradual resolution panel driving.

FIG. 3 is block diagram of an example system 300 that performs gradual resolution panel driving. Briefly, and described below in more detail, the system 300 includes a gradual resolution compensator 310, a driver integrated circuit 320, and a display panel 330. In some implementations, the system 300 may be included in the computing device 102 shown in FIG. 1.

The gradual resolution compensator 310 may receive image content to be shown on the display panel 330 and a deactivation pattern. For example, the gradual resolution compensator 310 may receive red, green, blue (RGB) values for coordinates for every pixel in the display panel 330 and also obtain, from storage of the computing device 102, a deactivation pattern that indicates pixels in the display panel 330 are to be deactivated as shown in the first area 210 in FIG. 2A.

The deactivation pattern may indicate, for each pixel in the display panel 330, whether the pixel should be activated or deactivated. For example, the deactivation pattern may store a binary value of zero or one for each pixel in the display panel 330, where zero indicates the pixel is to be deactivated and one indicates the pixel is to be deactivated.

The gradual resolution compensator 310 may generate compensated image content based on the image content and the deactivation pattern. For example, the gradual resolution compensator 310 may generate compensated image content that includes RGB values for each pixel in the display panel 330, where most of the RGB values in the pixels are identical to the image content but some of the RGB values are set to zero, zero, zero that corresponds to the pixel being deactivated.

In some implementations, the gradual resolution compensator 310 may, for each pixel in the image content, multiply the RGB values by the binary value indicated for the pixel by the deactivation pattern. For example, the gradual resolution compensator 310 may multiply RGB values of 80, 80, 80 for a pixel in the image content with a value of one from the deactivation pattern for the pixel to result in a RGB value of 80, 80, 80 for the pixel in the compensated image content, so the pixel in the display panel 330 is not deactivated. In another example, the gradual resolution compensator 310 may multiply RGB values of 70, 70, 70 for a second pixel in the image content with a value of zero for the pixel from the deactivation pattern to result in a RGB value of 0, 0, 0 for the second pixel in the compensated image content, so the second pixel in the display panel 330 is deactivated.

The driver integrated circuit 320 may obtain the compensated image content and determine corresponding voltage that is then applied to the display panel 330. For example, the driver integrated circuit 320 may be configured to map particular RGB values to particular voltages. In some implementations, the driver integrated circuit 320 outputs zero voltage for RGB values of zero, zero, zero, and the display panel 330 does not emit light when zero voltage is received. Accordingly, pixels of the display panel 330 which correspond to RGB values of zero, zero, zero may be deactivated and not emit light.

The gradual resolution compensator 310 may be implemented by hardware or software that executes on hardware. For example, the gradual resolution compensator 310 may be implemented on a processor in the computing device 102 or may be implemented by a dedicated circuit that only performs the functionality described for the gradual resolution compensator 310.

Figure 4:
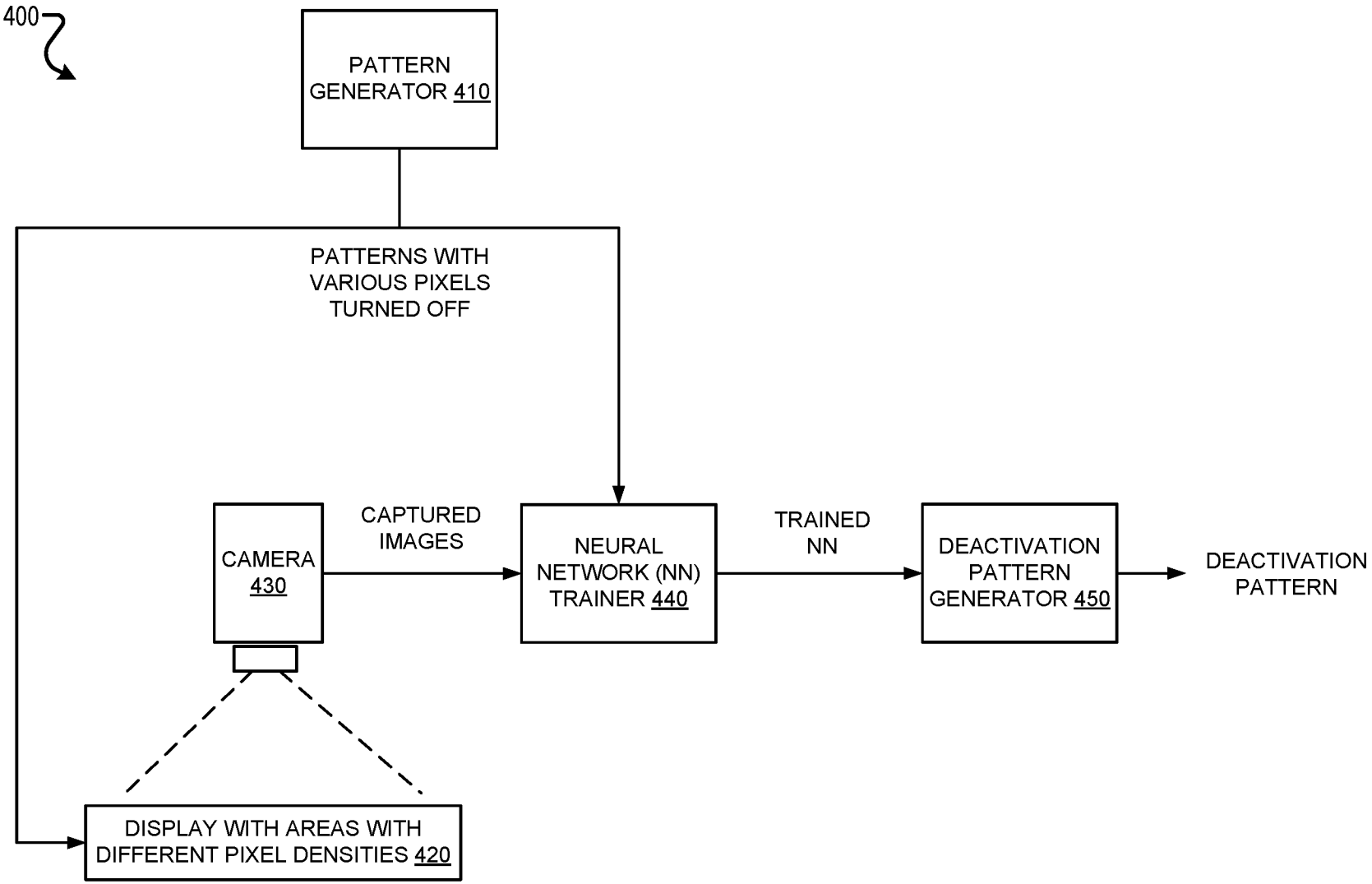
FIG. 4 is block diagram of an example system that generates a deactivation pattern.

FIG. 4 is block diagram of an example system 400 that generates a deactivation pattern. Briefly, and described below in more detail, the system 400 includes a pattern generator 410, a display with areas with different pixel densities 420, a camera 430, a neural network (NN) trainer 440, and a deactivation pattern generator 450. The deactivation pattern generated by the system 400 may be provided to the gradual resolution compensator 310. For example, the system 400 may generate the deactivation pattern at a factory during calibration on a particular display panel of a computing device, provide the deactivation pattern to the computing device, and the computing device may then store the deactivation pattern and use the deactivation pattern when displaying images.

The pattern generator 410 may generate patterns with various pixels turned deactivated. The pattern generator 410 may generate thousands of images with RGB values for pixels range from zero to two hundred fifty five, where pixels within an image have RGB values that are independent of one another. Each of the images may be a pattern. The display with areas with different pixel densities 420 may receive the patterns and sequentially display based on the patterns, and the camera 430 may capture an image of the display 420 for each pattern. For example, the display 420 may be the display panel 330 that sequentially displays one of the patterns every second and the camera 430 may capture an image of the display 420 every second. The camera 430 may store images as XYZ images.

The NN trainer 440 may receive the images of the display 420 captured by the camera 430 and receive the patterns, label each of the images with the corresponding pattern that was displayed when the image was captured, and then train a neural network based on the labeled images. For example, based on the XYZ images labeled with corresponding RGB images, the NN trainer 440 may train a neural network to receive an XYZ image as input and output a RGB image that, when displayed on the display 420, is predicated to result in the XYZ image.

The deactivation pattern generator 450 may receive the trained neural network from the NN trainer 440 and generate the deactivation pattern. For example, the deactivation pattern generator 450 may receive a trained neural network and then output a deactivation pattern that indicates which pixels in the first area 210 are to be deactivated.

In some implementations, the deactivation pattern generator 450 may generate the deactivation pattern based on the following cost function $C=\|F(Xi,Yi,Zi)-(Ri,Gi,Bi)\|+G(Wj,k)\cdot\lambda$, where $\lambda$ is a weight for the regularization term, $F(Xi,Yi,Zi)$ is neural network prediction for desired (Ri,Gi,Bi), W is the deactivation pattern, and $G(Wj,k)$ is a regularization term that generates more 0 values for each (Ri,Gi,Bi), e.g., $G(Wj,k)=\|Wj,k\|$.

Accordingly, gradual resolution panel driving may be implemented by displaying an image on an OLED display panel that includes a first display area having a first pixel density and a second display area having a second pixel density lower than the first pixel density, and while displaying the image, deactivating individual pixels in the first display area corresponding to a proximity of the individual pixels to the second display area such that a region of the first display area adjacent the second display area has a virtual pixel density between the first pixel density and the second pixel density.

For example, an image may be displayed on the display panel 200 which has a first area 210 with a high PPI and a second area 220 with a low PPI, and while displaying, the gradual resolution compensator 310 deactivates more pixels in rows of pixels of the first area 210 that are closer to the second area 220 so that a row of pixels in the first area 210 has a virtual PPI between the high PPI and the low PPI.

In some implementations, while displaying the image, regions of the first display area that are more proximate to the second display area have virtual pixel densities that are more similar to the second pixel density. For example, the row of pixels of the first area 210 that is closest to the second area 220 may have a virtual PPI that is closer to the PPI of the second area 220 than the row of pixels at the top of the first area 210.

In some implementations, the first display area includes pixels that are less spaced apart than pixels in the second display area. For example, the first area 210 may include four pixels in a unit area and the second area 220 may only include a single pixel in the same unit area.

In some implementations, the virtual pixel density is a density of pixels that emit light when the image is shown. For example, having four pixels that emit light in a unit area corresponds to a higher virtual pixel density than having one pixel emit light in the unit area.

In some implementations, deactivating individual pixels in the first display area corresponding to a proximity of the individual pixels to the second display area such that a region of the first display area adjacent the second display area has a virtual pixel density between the first pixel density and the second pixel density includes receiving a deactivation pattern that indicates the individual pixels in the first display area to be deactivated while the image is displayed and deactivating the individual pixels in the first display area in accordance with the deactivation pattern. For example, the gradual resolution compensator 310 on the computing device 102 may access the deactivation pattern from storage on the computing device 102, and then deactivate the pixels in the first area 210 as shown in FIG. 2A based on the deactivation pattern.

In some implementations, the deactivation pattern includes a map of all the pixels in the display panel where the map indicates whether each of the pixels in the display panel should be kept off when images are displayed on the display panel. For example, the deactivation pattern may include a binary variable for each pixel in the display panel 330, where a zero value for the binary variable indicates that the pixel is to be deactivated and a one value for the binary variable indicates that the pixel is to be activated.

In some implementations, the deactivation pattern is determined based on images of the display panel driven with various configurations of the pixels turned off. For example, the deactivation pattern may be determined by the deactivation pattern generator 450 based on the neural network that is trained using images of the display panel with various pixels turned off.

In some implementations, deactivating individual pixels in the first display area includes for each of the individual pixels that are to be deactivated, providing red, green, and blue values of zero, zero, zero for the pixel to a driver circuit for the display. For example, the gradual resolution compensator 310 may multiply RGB values of image content with binary values in the deactivation pattern and determine RGB values of zero, zero, zero for pixels that are to be deactivated.

In some implementations, the same pixels are always deactivated by the gradual resolution compensator 310 no matter what image is to be displayed. For example, the deactivation pattern has only binary values for each pixel coordinate that are used no matter what is the image content to be shown on the display panel 330.

Embodiments of the subject matter and the operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer programs, i.e., one or more modules of computer program instructions, encoded on computer storage medium for execution by, or to control the operation of, data processing apparatus.

A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple compact disks (CDs), disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., a FPGA or an ASIC.

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM (erasable programmable read-only memory), EEPROM (electrically erasable programmable read-only memory), and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's user device in response to requests received from the web browser.

Embodiments of the subject matter described in this specification can be implemented in a computing system that includes a back-end component, e.g., a data server, or that includes a middleware component, e.g., an application server, or that includes a front-end component, e.g., a user computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include users and servers. A user and server are generally remote from each other and typically interact through a communication network. The relationship of user and server arises by virtue of computer programs running on the respective computers and having a user-server relationship to each other. In some embodiments, a server transmits data (e.g., an HTML page) to a user device (e.g., for purposes of displaying data to and receiving user input from a user interacting with the user device). Data generated at the user device (e.g., a result of the user interaction) can be received from the user device at the server.

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A method comprising:

receiving a deactivation pattern for a light-emitting diode (LED) display panel comprising a first display area having a first pixel density and a second display area having a second pixel density lower than the first pixel density, wherein the deactivation pattern indicates individual pixels in the first display area to be deactivated when the LED display panel displays image content, the deactivation pattern having been determined based on images of the LED display panel that were captured by an external camera while the LED display panel was driven with various different patterns of pixels in the first display area having been turned off;

displaying image content on the LED display, and while displaying the image content, deactivating the individual pixels in the first display area in accordance with the deactivation pattern, the individual pixels deactivated in the first display area being proximate the second display area such that a region of the first display area adjacent the second display area has a virtual pixel density between the first pixel density and the second pixel density.

2. The method of claim 1, wherein, while displaying the image content, regions of the first display area that are more proximate to the second display area have virtual pixel densities that are more similar to the second pixel density.

3. The method of claim 1, wherein the first display area includes pixels that are less spaced apart than pixels in the second display area.

4. The method of claim 1, wherein the virtual pixel density comprises a density of pixels that emit light when the image content is shown.

5. The method of claim 1, wherein the deactivation pattern comprises a map of all the individual pixels in the display panel where the map indicates whether each of the individuals pixels in the display panel should be kept off when image content are displayed on the display panel.

6. The method of claim 1, wherein receiving a deactivation pattern comprises:

accessing the deactivation pattern from storage on a computing device that includes the display panel.

7. The method of claim 1, wherein the images of the LED display panel driven with various different patterns of pixels in the first display area having been turned off are obtained by the external camera facing the display panel during a factory calibration process.

8. The method of claim 1, wherein deactivating the individual pixels in the first display area comprises:

for each of the individual pixels that are to be deactivated, providing red, green, and blue values of zero, zero, zero for the individual pixel to a driver circuit for the LED display panel.

9. The method of claim 1, wherein the second display area is surrounded by the first display area.

10. The method of claim 1, wherein deactivating the individual pixels in the first display area in accordance with the deactivation pattern comprises:

deactivating the individual pixels in the first display area such that a line of pixels, where each of the individual pixels in the line of pixels is adjacent to the second display area, and three lines of pixels in the first display area both parallel to the line of pixels and closest to the line of pixels have different sequences of deactivated pixels.

11. The method of claim 1, wherein deactivating the individual pixels in the first display area in accordance with the deactivation pattern comprises:

activating a first pixel in a line of pixels in the first display area, where each of the individual pixels in the line of pixels is adjacent to the second display area, and a second pixel both adjacent to the first pixel and not in the line of pixels.

12. A system comprising:

one or more computers and one or more storage devices storing instructions that are operable, when executed by the one or more computers, to cause the one or more computers to perform operations comprising:

receiving a deactivation pattern for a light-emitting diode (LED) display panel comprising a first display area having a first pixel density and a second display area having a second pixel density lower than the first pixel density, wherein the deactivation pattern indicates individual pixels in the first display area to be deactivated when the LED display panel displays image content, the deactivation pattern having been determined based on images of the LED display panel that were captured by an external camera while the LED display panel was driven with various different patterns of pixels in the first display area having been turned off;

displaying image content on the LED display, and while displaying the image content, deactivating the individual pixels in the first display area in accordance with the deactivation pattern, the individual pixels deactivated in the first display area being proximate the second display area such that a region of the first display area adjacent the second display area has a virtual pixel density between the first pixel density and the second pixel density.

13. The system of claim 12, wherein, while displaying the image content, regions of the first display area that are more proximate to the second display area have virtual pixel densities that are more similar to the second pixel density.

14. The system of claim 12, wherein the first display area includes pixels that are less spaced apart than pixels in the second display area.

15. The system of claim 12, wherein the virtual pixel density comprises a density of pixels that emit light when the image content is shown.

16. The system of claim 12, wherein the deactivation pattern comprises a map of all the individual pixels in the display panel where the map indicates whether each of the individuals pixels in the display panel should be kept off when image content are displayed on the display panel.

17. A non-transitory computer-readable medium storing software comprising instructions executable by one or more computers which, upon such execution, cause the one or more computers to perform operations comprising:

receiving a deactivation pattern for a light-emitting diode (LED) display panel comprising a first display area having a first pixel density and a second display area having a second pixel density lower than the first pixel density, wherein the deactivation pattern indicates individual pixels in the first display area to be deactivated when the LED display panel displays image content, the deactivation pattern having been determined based on images of the LED display panel that were captured by an external camera while the LED display panel was driven with various different patterns of pixels in the first display area having been turned off;

displaying image content on the LED display, and while displaying the image content, deactivating the individual pixels in the first display area in accordance with the deactivation pattern, the individual pixels deactivated in the first display area being proximate the second display area such that a region of the first display area adjacent the second display area has a virtual pixel density between the first pixel density and the second pixel density.

18. The method of claim 1, wherein the deactivation pattern is determined based on a neural network that is trained on the images, of the LED display panel that were captured by an external camera while the LED display panel was driven with various different patterns of pixels in the first display area having been turned off.

* * * * *